United States Patent [19]

Dorren

[11] 4,190,737

[45] * Feb. 26, 1980

[54] COMPATIBLE FOUR CHANNEL FM SYSTEM

[75] Inventor: Louis Dorren, Millbrae, Calif.

[73] Assignee: Matsushita Electric Corp. of America, Secaucus, N.J.

[ * ] Notice: The portion of the term of this patent subsequent to Jan. 2, 1988, has been disclaimed.

[21] Appl. No.: 649,153

[22] Filed: Jan. 14, 1976

Related U.S. Application Data

[63] Continuation of Ser. No. 482,415, Jun. 24, 1974, Pat. No. 3,967,069, which is a continuation of Ser. No. 319,939, Dec. 29, 1972, Pat. No. 3,822,365, which is a continuation of Ser. No. 32,989, Apr. 29, 1970, Pat. No. 3,708,623, which is a continuation-in-part of Ser. No. 13,902, Feb. 25, 1970, abandoned.

[51] Int. Cl.[2] ..... H04H 5/00

[52] U.S. Cl. ..... 179/1 GH

[58] Field of Search ..... 179/15 BT, 100.1 TD, 179/100.4 ST, 1 GQ, 1 GH, 1 GE; 325/36

[56] References Cited

U.S. PATENT DOCUMENTS

| | | | |
|---|---|---|---|
| 3,122,610 | 2/1964 | Csicsatka | 179/1 GD |
| 3,133,993 | 5/1964 | DeVries | 179/1 GD |
| 3,257,511 | 6/1966 | Adler | 179/1 GE |
| 3,538,259 | 11/1970 | Brahman | 179/15 BT |
| 3,708,623 | 1/1973 | Dorren | 179/15 BT |
| 3,822,365 | 7/1974 | Dorren | 179/15 BT |

OTHER PUBLICATIONS

"Quadrasonics on the Air" by Feldman, in *Audio* Jan. 1970, pp. 22–24, 78 & 79.

*Carrier Current Telephone and Telegraphy,* Colpitts et al, "Transaction of the AIee" vol. XL, Jan.–Dec. 1921.

*Primary Examiner*—Douglas W. Olms

[57] ABSTRACT

A four channel FM system is described. In one embodiment the usual 19 kHz pilot signal is employed to switch between front and rear information, while in another, a 76 kHz switching signal is employed for this purpose.

4 Claims, 15 Drawing Figures

COMPATIBLE FOUR CHANNEL FM SYSTEM

CROSS REFERENCE TO RELATED APPLICATIONS

This is a continuation of application Ser. No. 482,415 filed June 24, 1974 which is now U.S. Pat. No. 3,967,069 which in turn is a continuation of application Ser. No. 319,939 filed on Dec.. 29, 1972 which is now U.S. Pat. No. 3,822,365 which in turn is a continuation of application Ser. No. 32,989 filed Apr. 29, 1970, which is now U.S. Pat. No. 3,708,623 which in turn is a continuation in part of application Ser. No. 13,902 filed Feb. 25, 1970 now abandoned.

SUMMARY OF THE INVENTION

A four channel audio system is provided which is fully compatible with standard FM stereo and mono equipment. According to the present invention, a switching or sampling system is employed so that four audio channels are transmitted by the FM station. These four channels are designated left front, right front, left rear and right rear and are sometimes hereinafter abbreviated LF, RF, LR and RR, respectively.

In accordance with one embodiment of the invention, these four channels are superimposed on the 38 kHz subcarrier and the usual 19 kHz pilot signal is used as a switching signal. During the first half cycle of the 19 kHz signal, the left front and right front information is transmitted while during the second half cycle, the left rear and right rear information is transmitted. The 19 kHz pilot is then used as a switching signal between the front and rear information as is hereinafter described in detail while the 38 kHz signal switches between left and right in the usual manner. This system has the advantage of not requiring an increase in bandwidth, not requiring any additional pilot or subcarrier frequencies and permits the radio station to continue to use its normal 67 kHz subcarrier for SCA purposes. However, this embodiment does not ordinarily permit the use of the full frequency spectrum for front and back information so that it is sometimes preferable to provide another subcarrier to carry the front and rear information. When this is done, the 19 kHz pilot signal is quadrupled and this quadrupled signal is used for switching between front and back information.

Both embodiments of the present invention are completely compatible with present mono and stereo equipment. The main channel carriers all four aduio channels so that on a mono receiver the four audio signals are combined. On a stereo receiver, the left and the right information is extracted in the usual manner and it is only with the receiver equipped for four channel reception that the signal produced by the system of the present invention is broken into its four components. The system utilizing the 76 kHz switching signal has the additional advantage that there is a complete reproduction of the full audio bandwidth by each of the four channels.

The above FIGS. 1 through 9 relate to an embodiment wherein the 19 kHz pilot signal is employed to switch between front and rear information. The following figures relate to that embodiment of the invention wherein a 76 kHz subcarrier and switching signal is employed.

Figure 10:
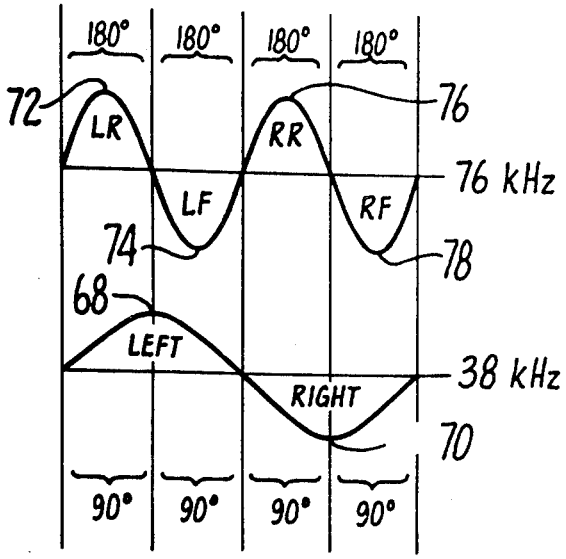

FIG. 10 is a wave form of that embodiment of the invention wherein a 76 kHz subcarrier is employed.

Figure 11:
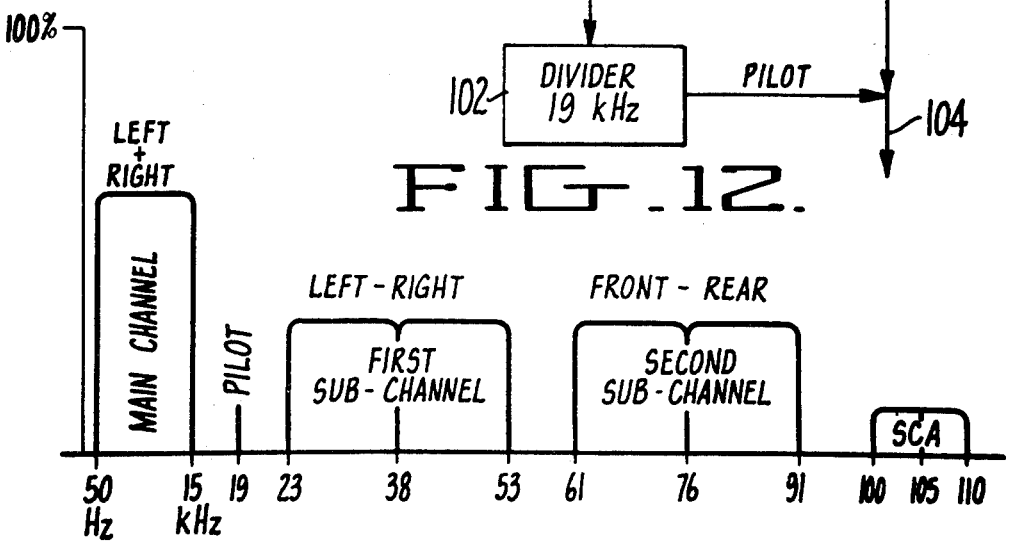

FIG. 11 is a band distribution diagram of the system using the 76 kHz subcarrier.

Figure 12:
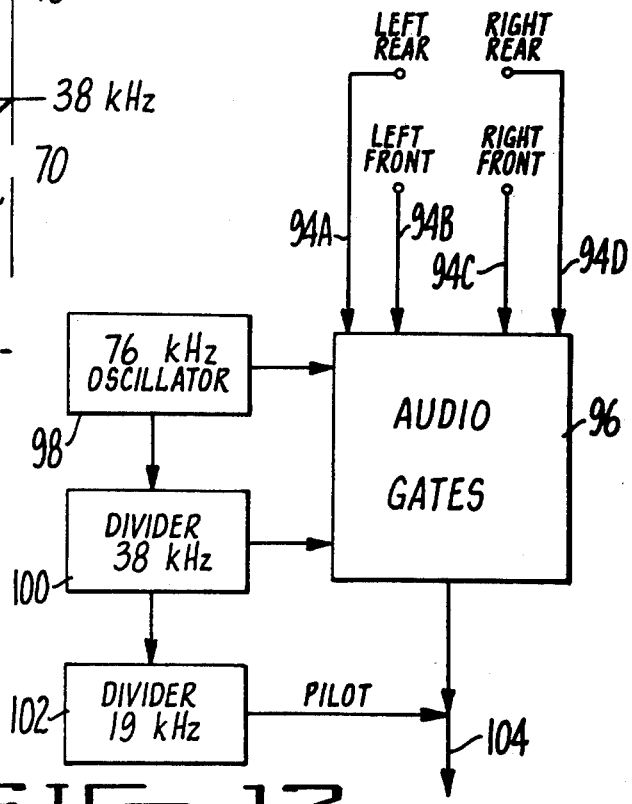

FIG. 12 is a block diagram of the encoder employed with the 76 kHz subcarrier system.

Figure 13:
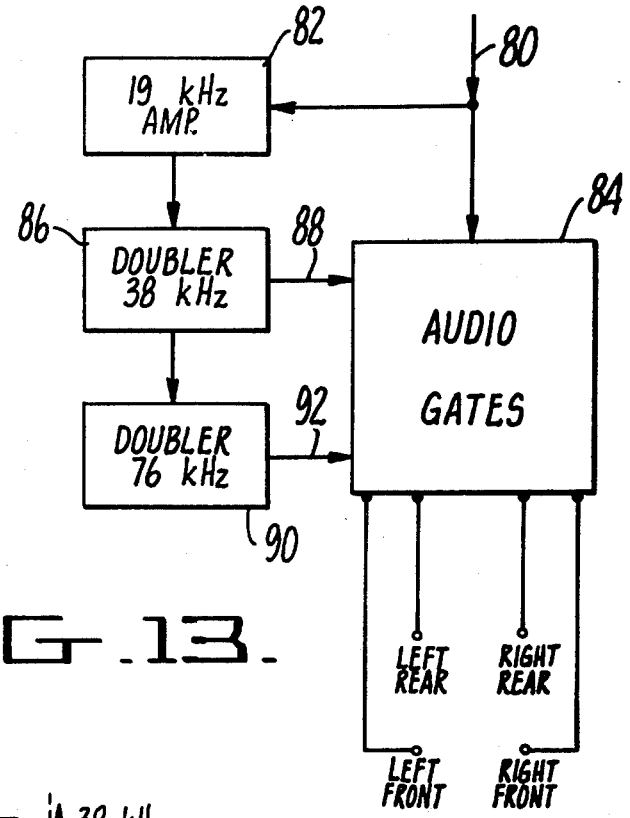

FIG. 13 is a block diagram of the receiver employed with the system.

Figure 14:
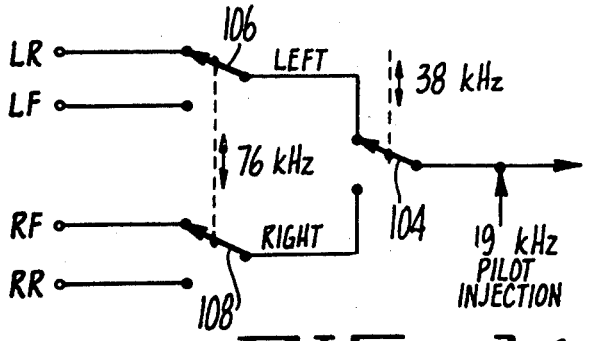

FIG. 14 is a switch analogy for the transmitter.

Figure 15:
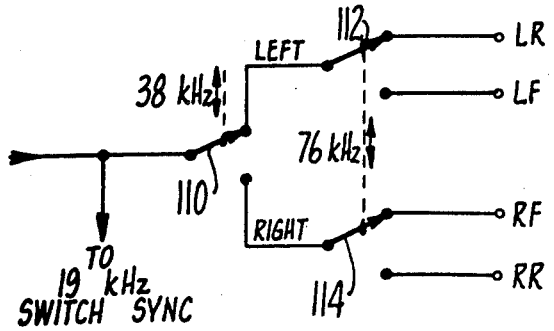

FIG. 15 is a switch analogy for the receiver.

DESCRIPTION OF THE PREFERRED EMBODIMENTS

Reference is made to FIGS. 1 through 9 which illustrate that embodiment of the invention employing a 19 kHz switching signal.

At the present time, the authorized stereophonic system used in the United States includes a multiplex signal wherein left and right channel information is carried on a single carrier wave. The composite signal includes a main channel signal on the carrier frequency which contains both the right and left hand signals. A suppressed carrier double side band signal is provided on a subcarrier at 38 kHz which carries the left minus right signal. A 19 kHz pilot signal is provided for phase lock of the 38 kHz side bands. In addition, there may be a subsidiary communication authorization (S.C.A.) signal at 67 kHz and this system does not interfere with the S.C.A. signal. In general, this embodiment of the invention is carried out by employing the 19 kHz pilot signal as a switching signal to switch between front and back information to provide for front and back as well as left and right signals.

Figure 1:
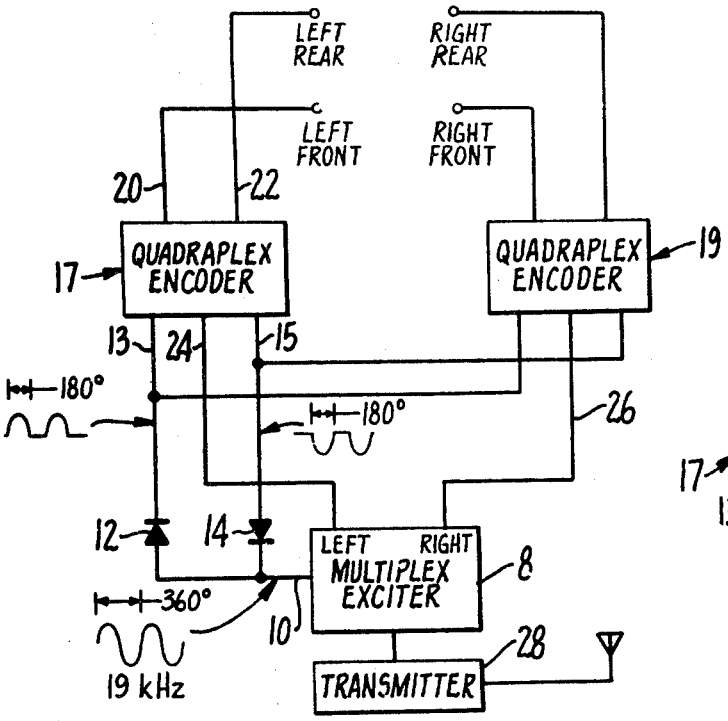
FIG. 1 is a block diagram of a transmitter embodying the present invention.
Figure 3:
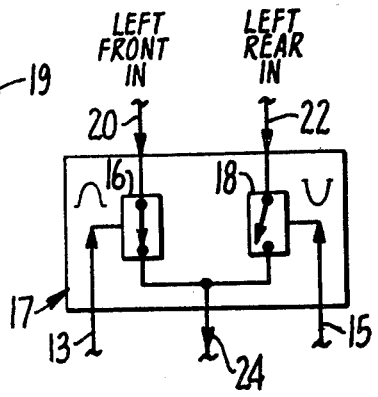
FIG. 3 is an analogy diagram of one of the encoders shown in FIG. 1.

The method of transmitting the signal is shown in FIGS. 1 and 3. A standard multiplex exciter 8 is employed, and this generates a 19 kHz pilot signal which serves as the switching signal for the front and rear information. This signal is passed through lead 10 to diodes 12 and 14 and alternate half cycles are passed by leads 13 and 15 to the encoders 17 and 19. One of these encoders is shown in analog form in FIG. 3 and consists of switches 16 and 18. The encoder has a line 20 leading to switch 16 for front information and a line 22 leading to switch 18 for rear information and a common output line 24. The switches are actuated by pulses from lines 13 and 15 respectively. Thus, on a positive half cycle of the 19 kHz signal, switch 16 is closed so that the front information is fed through line 24 while on the following negative half cycle, switch 18 is closed so that the rear information is fed through line 24. The other encoder is not described since it operates in exactly the same way with the right front and rear information. The left information is fed through line 24 to the multiplex exciter 8 while the corresponding right channel information is fed through line 26 to the exciter. The signal generated by the exciter is then fed to the transmitter 28.

Figure 5:
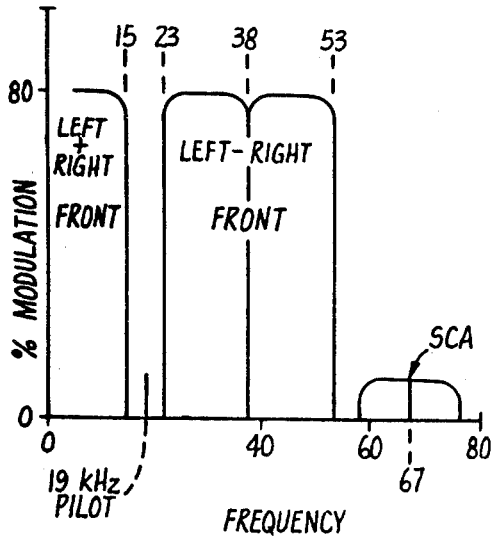
FIG. 5 is a spectrum diagram of the signal employed during the transmission of front channel information.
Figure 6:
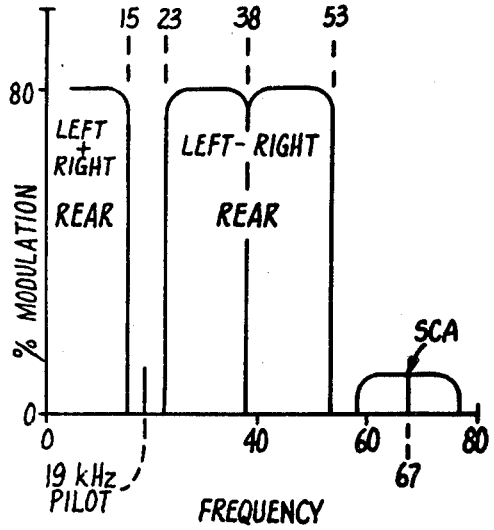
FIG. 6 is a similar diagram showing the signal employed during the transmission of rear channel information.

The signal thus generated can best be understood by reference to FIGS. 5 and 6. FIG. 5 represents the signal as it is being transmitted during the first or positive half cycle of the 19 kHz signal. It will be seen that at 0 frequency (zero in this sense represents the nominal carrier frequency of the FM station) there is present up to 15 kHz, a signal representing the left front plus right front information. Centered on 38 kHz is the left front minus right front information. In FIG. 6 the signal is shown during the second or negative half cycle of the 19 kHz signal. During this half cycle, the main channel is carrying the left plus right information but in this case it is the rear information while similarly centerd on 38 kHz the left minus right information is sent but here again it is the rear information. It will be seen that in both instances, there is no interference with the normal S.C.A. signal.

Figure 2:
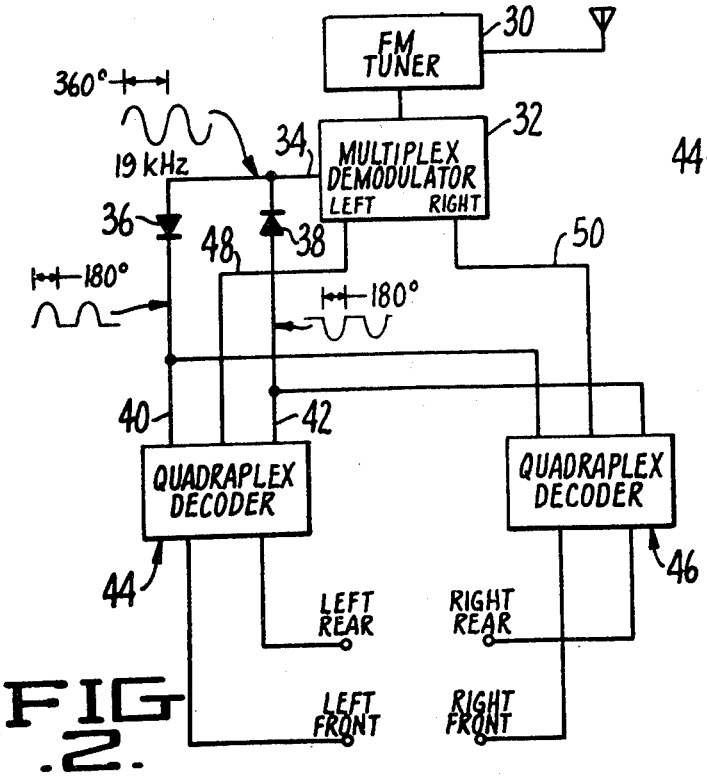
FIG. 2 is a block diagram of a receiver embodying the present invention.
Figure 4:
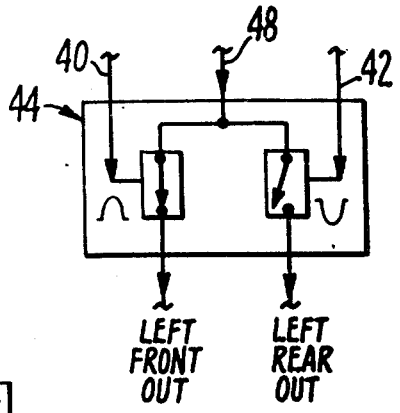
FIG. 4 is a similar diagram of one of the decoders utilized in FIG. 2.

The method of receiving a signal is shown in FIGS. 2 and 4. The signal is received on an ordinary FM tuner 30 and fed to a standard multiplex demodulator 32. The 19 kHz signal is taken from line 34 and passed to diodes 36 and 38 and the rectified 19 kHz pulses are passed through lines 40 and 42 to the decoders 44 and 46. The left and right channel information is taken from the demodulator 32 and passed through lines 48 and 50 to the respective decoders. Referring now specifically to FIG. 4, the upper switch is actuated by the positive half cycles from line 40 while the lower switch is operated by the negative half cycles from line 42 so that the decoder switches between the left front and the right front on positive and negative pulses of the 19 kHz signal. The signals are then taken from the decoder and amplified in the usual way. At the same time, the right channel information is handled in the same manner by the decoder 46.

In order to prevent high frequency components of the incoming program information from interfering with operation of the system, low pass filters which pass only frequencies below 15 kHz are employed in the input leads to the encoders, i.e. leads 20 and 22 of encoder 17 and the corresponding leads of the right hand encoder 19. Similar low pass filters are also employed in the output leads of decoders 44 and 46.

Figure 7:
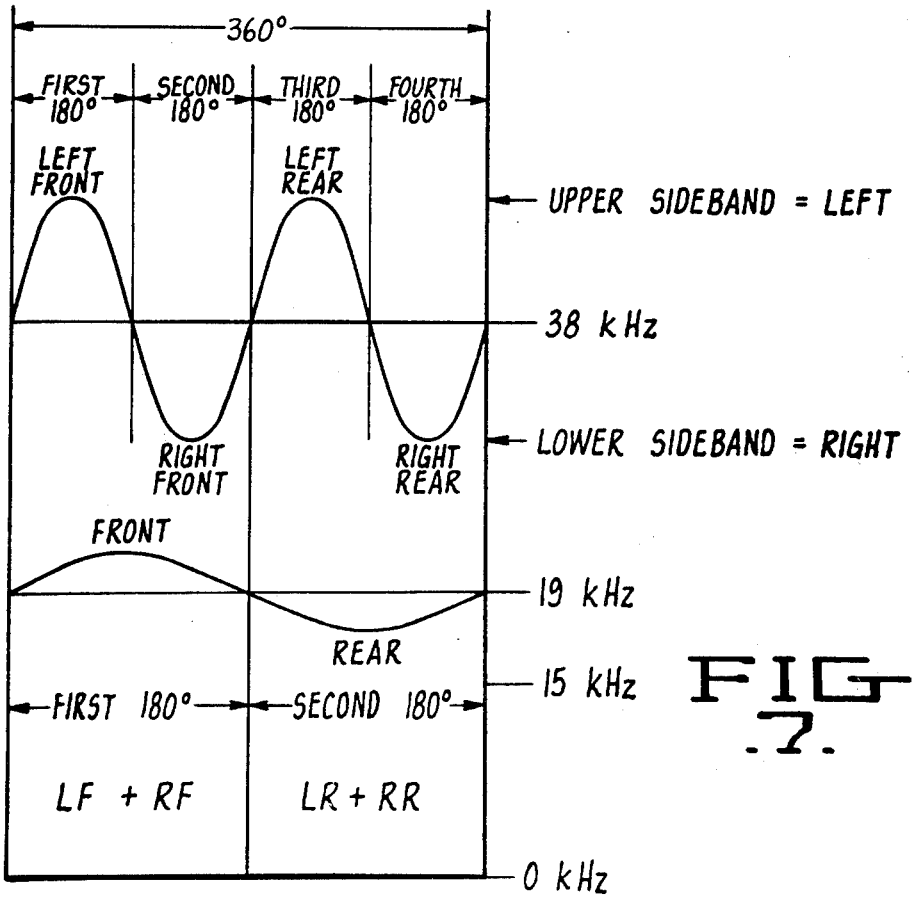
FIG. 7 is a diagram of the composite wave form employed.

The operation of the overall system can best be seen in FIG. 7 wherein it is assumed that demodulation takes place on a time division basis although it will be obvious that the invention is equally applicable to demodulators which operate on a matrixing system or a combination of time division and matrixing. FIG. 7 represents one complete cycle of the 19 kHz signal and two complete cycles of the 38 kHz subcarrier. During the first half of the 19 kHz cycle, front information exclusively is being sent both on the main channel and on the 38 kHz subcarrier. In the case of the main channel, this is a combination of the left front and right front information while on the 38 kHz subcarrier, left front information is being sent on the upper side band and right front information on the lower side band. During the next half cycle of the 19 kHz signal, the situation is reversed with the main channel carrying left rear plus right rear information while on the 38 kHz signal, left rear information is carried on the upper side band while right rear information is carried on the lower side band.

Although the embodiment heretofore described is a fully workable system, some modifications can be made for optimum results.

Figure 8:
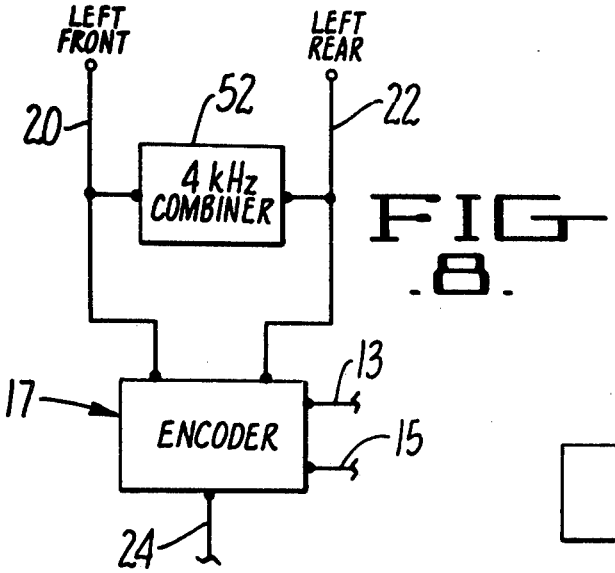
FIG. 8 is a block diagram showing how combiner networks can be employed with the encoders to eliminate beat notes.

When the full bandwidth of 15 kHz is transmitted with this signal, a 15 kHz audio tone will produce sidebands of 4 kHz and 34 kHz when imposed on the 19 kHz pilot signal. The 34 kHz signal will beat with sideband components of the 38 kHz subchannel causing beat frequencies in the sub and main channels, and the 4 kHz signal will beat with the main channel audio components, creating beat frequencies lying within the audible range. Thus, to employ the full 15 kHz bandwith, it is desirable to provide a combining network on the inputs to the encoder as is shown in FIG. 8. Here the left channel encoder 17 having the inputs 20 and 22, previously described, has a combining network 52 connected between the input lines. Obviously the right channel is treated the same way. This combining network combines all frequencies above 4 kHz so that for the higher frequencies, the information is carried on both the front and the rear channels. At frequencies under 4 kHz there is a separation between front and back. This gives very good presence since it has been found that a great deal of the separation presence occurs below 4 kHz.

Figure 9:
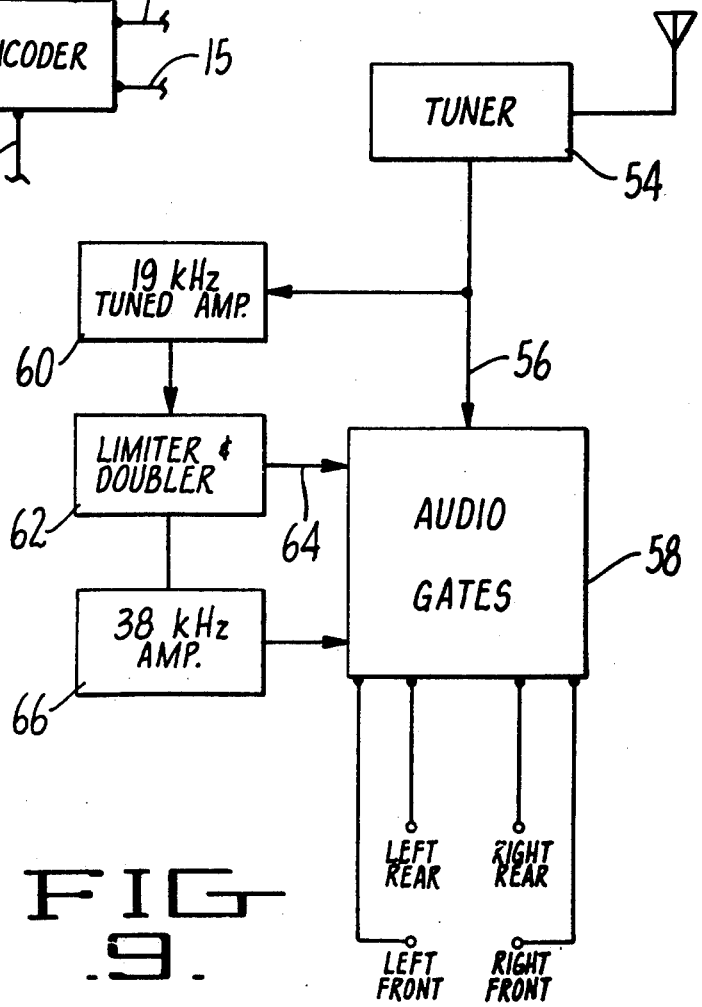
FIG. 9 is a block diagram showing a limiter circuit which is desirable to employ with certain types of FM receivers.

With some relatively inexpensive FM receivers, some distortion may be encountered for the reason that such receivers employ a 19 kHz tuned amplifier together with a doubler. The 19 kHz signal in the case of such receiver is not a clean 19 kHz but has certain modulation components imposed thereon. In other words, the 19 kHz switching signal contains amplitude modulated components so that switching does not always take place at the exact points desired. In order to remedy this, a limiter as is shown in FIG. 9 may be employed with such receivers. Here the tuner 54 feeds a signal through line 56 to the audio gates 58 and at the same time the signal is fed to the 19 kHz tuned amplifier 60. The 19 kHz signal is now passed to the limiter and doubler 62. The limited 19 kHz signal is passed through line 64 to the audio gates to perform the switching function and, since it is now free of all amplituded modulated components, provides clean switching action. The doubled signal is fed to the 38 kHz amplifier 66 which serves as the switching signal for the right and left information in the usual manner. Most FM receivers do not require this added circuitry, particularly the better grade of receivers which use a phase locked oscillator rather than the simple tuned amplifier and doubler.

The same basic system is used in the scheme shown in FIGS. 10 through 15 except here instead of using the 19 kHz signal to switch between front and rear information, the 19 kHz signal is first doubled in the usual manner to act as a switching signal for the left and right information and again doubled to produce a 76 kHz signal which serves to switch the front and rear information. In order to preserve compatibility, the order in which the audio signals are transmitted is changed to LR, LF, RR and RF. It is also necessary to make a change in the bandwidth to handle the system and in the specific system described, this must be at least 91 kHz for the four channel transmission and it may be increased to 110 kHz to handle S.C.A. subcarrier.

In FIG. 11, one half of the composite signal is shown. Thus, there is a main channel in the usual manner extending from 50 Hz to 15 kHz and this contains the left plus right information, both front and rear. There is a pilot signal at 19 kHz and a first subchannel centered on 38 kHz. This first subchannel contains the left minus right information, including both front and rear. A second subchannel is centered on 76 kHz and this contains the front minus rear information.

Summing up the above, it can be seen that the novel composite signal of the present invention includes the following:

A main channel extending up to 15 kHz and including the sum of the signals, for example, left and right both front and rear.

A 19 kHz pilot signal. A first sub-channel centered on 38 kHz containing left minus right information.

A sub-channel centered on 76 kHz containing front minus rear information.

If this signal is studied, purely mathematical Fourier analysis shows that the following signal equations actually exist. The first of these equations is assigned to the main channel and is the sum of the signals, i.e., (LF+LR+RF+RR); this main channel extending up to 15 kHz. The second equation is (LF+LR−RF−RR) and is located in the first subchannel which is centered at 38 kHz. Also located in the first sub-channel is another equation (LF−LR−RF+RR). To differentiate these two equations, they are modulated in quadrature; that is, the first being the sine of 38 kHz and the second being the cosine of 38 kHz. The final equation is centered at 76 kHz is (LF−LR+RF−RR).

With the production of these four equations in the base band signal, we have now satisfied the algebraic conditions of transmission. The purely mathematical Fourier analysis is as follows:

ANALYTICAL DESCRIPTION OF THE DORREN QUADRAPLEX COMPOSITE SIGNAL

Notation:

ai (t): Audio signal applied to channel I; I=1, 2, 3, & 4.

si (t): Modulating function of channel I, that is, so that ai (t), si (t) is the contribution of channel I to the composite signal.

c (t): Composite signal.

f: Frequency of pilot 19 kilohertz.

t: One period of 38 kilohertz of sinusoid 2 ft=1.

ANALYSIS: THE MODULATING FUNCTION OF FOUR CHANNELS

The modulating functions of four channels are assumed to vary in the ways shown below.

The origin of the time scale is chosen as the beginning of one of the sampling pulses:

s1 (t):

s2 (t)=s1 (t−t/4)

s3 (t)=s2 (t−t/4)

s4 (t)=s3 (t−t/4)

si (t) is a periodic function with a fundamental frequency 2f and has a fourier series representation:

$$s1(t) = \frac{E}{4}\left\{1 + \sum_{n=1}^{\infty} \frac{4}{n\pi} \sin\frac{n\pi}{2} \cos 4\pi nft + \sum_{n=1}^{\infty} \frac{4}{n\pi}\left(1 - \cos\frac{n\pi}{2}\right) \sin 4\pi nft\right\}$$

Retaining only the 36 kilohertz and 76 kilohertz components and applying the relations of one to generate the other three functions, we get:

$$s1(t) = \frac{E}{4}\left\{1 + \frac{4}{\pi}\text{ cosine } 4\pi\text{ ft} + \frac{4}{\pi}\text{ sine } 4\pi\text{ ft} + \frac{4}{\pi}\text{ sine } 8\pi\text{ ft.}\right\}$$

$$s2(t) = \frac{E}{4}\left\{1 - \frac{4}{\pi}\text{ cosine } 4\pi\text{ ft} + \frac{4}{\pi}\text{ sine } 4\pi\text{ ft} - \frac{4}{\pi}\text{ sine } 8\pi\text{ ft.}\right\}$$

$$s3(t) = \frac{E}{4}\left\{1 - \frac{4}{\pi}\text{ cosine } 4\pi\text{ ft} - \frac{4}{\pi}\text{ sine } 4\pi\text{ ft} + \frac{4}{\pi}\text{ sine } 8\pi\text{ ft.}\right\}$$

$$s4(t) = \frac{E}{4}\left\{1 + \frac{4}{\pi}\text{ cosine } 4\pi\text{ ft} - \frac{4}{\pi}\text{ sine } 4\pi\text{ ft} - \frac{4}{\pi}\text{ sine } 8\pi\text{ ft.}\right\}$$

Multiplying si (t) by ai (t) and summing to give the composite, we get:

$$\begin{aligned} c(t) = \frac{E}{4}\{&a1 + a2 + a3 + a4 \\ &+ (a1 + a2 - a3 - a4)\text{ sine } 4\pi\text{ ft} \\ &+ (a1 - a2 - a3 + a4)\text{ cosine } 4\pi\text{ ft,} \\ &+ (a1 - a2 + a3 - a4)\text{ sine } 8\pi\text{ ft.}\} \end{aligned}$$

To this signal a pilot should be added of the form A sin 2πft. We see that the quadraplex composite signal consists of:

(1) a main channel component (a1+a2+a3+a4).

(2) two 38 kilohertz components in quadrature, one modulated by (a1+a2−a3−a4) and the other modulated by (a1−a2−a3+a4).

(3) one 76 kilohertz component modulated by (a1−a2+a3−a4).

If we make the following channel identification, a1=left front signal a2=left rear signal a3=right front signal a4=right rear signal and assume the two channel stereo case in which, a1=a2=left a3=a4=right the composite signal reduces to c (t)=(E/4) (21+2r) +A sin 2πft+(21−2r) sin 4πft. This is the standard two channel stereo format with the pilot at 19 kilohertz and having the correct phase relationship to the 38 kilohertz subcarrier.

This composite signal is generated by the transmitter circuit as shown in FIG. 12 and the switch analogy as shown in FIG. 14 wherein the switch analogy switches at the rates of 76 kHz and 38 kHz.

If an S.C.A. signal is desired, this can be centered on 105 kHz, although the provision for such a signal forms no part of the present invention.

In FIG. 10, the sampling system is shown. There is shown one full cycle of the 38 kHz subcarrier and naturally two cycles of the newly generated 76 kHz subcarrier. The 38 kHz signal is utilized by a stereophonic receiver in the usual manner so that the sampling points would be at points 68 and 70 for the left and right handed information. Similarly, the signal centered on the 76 kHz subcarrier contains the front minus rear information so that on a four channel audio system the sampling points would be at 72, 74, 76 and 78 to extract the desired information.

In FIG. 13 there is shown a block diagram of how the decoder works. The composite signal comes from the tuner through line 80 and a portion of the composite signal goes to the 19 kHz amplifier 82. The composite signal is also fed to the audio gates 84. The 19 kHz signal is doubled to 38 kHz in the doubler 86 and this signal is passed through line 88 to the audio gate 84 where it is used to switch between the right and left information. A portion of the signal is also sent to the second doubler 90 which puts out a signal at 76 kHz through line 92 which is also sent to the audio gates and utilized to switch between front and back information.

The transmitter circuit is shown in FIG. 12 and essentially consists of the opposite circuit from that described for the decoder. Thus, four sources of audio are supplied through the four lines 94 A, B, C and D to the audio gates 96. A 76 kHz oscillator 98 is provided which sends a signal to the audio gates for switching between the front and the back information. The signal is divided by two in divider 100 and a portion of this 38 kHz signal is sent to the audio gates for switching between right and left information while a portion of this signal is sent to the divider 102 for the generation of the 19 kHz pilot signal. The pilot signal is combined with the composite signal from the audio gates to produce a composite signal on 104 which can be used to modulate a standard FM transmitter. Naturally this signal will look like the signal of FIG. 11 except that no description has been included of the generation of the SCA band.

FIG. 14 shows a mechanical switch analogy of the switching circuit and this as well as FIG. 15 should be utilized in conjunction with FIG. 10. Here switch 104 operates at a frequency of 38 kHz for sampling the right and left information while switch 106 operates at twice this frequency for sampling the left rear and left front information while switch 108 operates at the same frequency for the same purpose in the right channel. Thus one can visualize switch 104 in the upper position while switches 106 and 108 are also in the upper position. Switch 108 is in effect inoperative since the right channel is open but switch 106 switches the left rear information into the outgoing signal. Now switch 106 (as well as 108) moves to the lower position so that the left front information is sampled. After one complete cycle of the 76 kHz, switch 104 moves to the lower position while switch 108 repeats the operation for sampling the right front and rear information. FIG. 15 gives a similar analogy for the receiver where switch 110 operating at a frequency of 38 kHz switches between right and left information while switches 112 and 114 similarly switch between front and rear information. Naturally, these are only mechanical analogies and in a normal receiver or transmitter such switching is by solid state devices.

It will be apparent from this description that the signal is completely compatible with either a mono, stereo, or four channel receiver. Thus, on a mono receiver, one would hear the main channel which during two cycles of the 76 kHz subcarrier will contain the information from all four channels. On a stereo receiver, left front and left rear information will be extracted during the first 180° period of the 38 kHz subcarrrier while the right front and right rear information will be received during the second 180° period. On the four channel receiver, the four signals would be individually received as previously described.

It will be seen from the description which has been given that the complete signal of the first embodiment has been contained within the assigned bandwidth and that there has been no interference with an S.C.A. signal, if this is being sent. In the second embodiment the four signals are all modulated to the full 15 kHz bandwidth so that there is no deterioration of separation over this bandwidth. The four signals are also given the same percentage of modulation so there is no deterioration of the signal to noise ratio.

I claim:

1. A four channel FM system which is fully compatible with existing mono and stereo standards comprising means for producing a first combination of audio signals of a lower frequency band, means for producing a pilot signal having a frequency higher than the highest frequency of said audio signals, means for producing a second combination of said audio signals amplitude modulating a first subcarrier signal at a frequency double the frequency of said pilot signal, means for producing at least one of third and fourth combinations of said audio signals, said third combination of signals amplitude modulating a second subcarrier at a frequency double the frequency of said pilot signal and in quadrature with said second subcarrier signal, said fourth combination of said audio signals amplitude modulating a third subcarrier signal at a frequency related to the frequency of the pilot signal and different from the frequency of said first and second subcarrier, means for combining said first and second combinations of audio signals, said pilot signal and at least one of said third and fourth combinations of audio signals to produce a composite signal for use in the four channel FM system.

2. A four channel FM system which is fully compatible with existing mono and stereo standards comprising means for producing a first combination of audio signals of a lower frequency band, means for producing a pilot signal having a frequency higher than the highest frequency of said audio signals, means for producing a second combination of said audio signals amplitude modulating a first subcarrier signal at a frequency double the frequency of said pilot signal, means for producing a third combination of said audio signals amplitude modulating a second subcarrier at a frequency double the frequency of said pilot signal and in quadrature with said second subcarrier signal, means for producing a fourth combination of said audio signals amplitude modulating a third subcarrier signal at a frequency related to the frequency of said pilot signal and different from the frequency of said first and second subcarrier, means for combining said first, second, third and fourth combinations of audio signals with said pilot signal to produce a composite signal for use in the four channel FM system.

3. In a receiver for deriving at least one of first, second, third and fourth quadraphonically related audio frequency signals from a composite signal comprising a first combination of audio signals of a lower frequency band, a pilot signal having a frequency higher than the highest frequency of said audio signals, a second combination of said audio signals amplitude modulating a first subcarrier signal at a frequency double the frequency of said pilot signal, at least one of a third and a fourth combination of said audio signals, said third combination of signals amplitude modulating a second subcarrier at a frequency double the frequency of said pilot signal and in quadrature with said second subcarrier signal, said fourth combination of said audio signals amplitude modulating a third subcarrier signal at a frequency related to the frequency of said pilot signal and different from the frequency of said first and second subcarrier, the combination of means responsive to said composite signal for deriving a reference signal having a frequency related to the frequency of said pilot signal and means responsive to said reference signal and the components of said composite signal for deriving said first, second, third and fourth audio signals.

4. In a receiver for deriving at least one of first, second, third and fourth quadraphonically related audio frequency signals from a composite signal comprising a first combination of audio signals of a lower frequency band, a pilot signal having a frequency higher than the highest frequency of said audio signals, a second combination of said audio signals amplitude modulating a first subcarrier signal at a frequency double the frequency of said pilot signal, a third combination of said audio signals amplitude modulating a second subcarrier at a frequency double the frequency of said pilot signal and in quadrature with said second subcarrier signal, a fourth combination of said audio signals amplitude modulating a third subcarrier signal at a frequency related to the frequency of said pilot signal and different from the frequency of first and second subcarrier, the combination of means responsive to said composite signal for deriving reference signal having a frequency related to the frequency of said pilot signal, and means responsive to said reference signal and the components of said composite signal for deriving said first, second, third and fourth audio signals.

* * * * *

UNITED STATES PATENT AND TRADEMARK OFFICE

CERTIFICATE OF CORRECTION

PATENT NO. :4,190,737

DATED :February 26, 1980

INVENTOR(S) :Louis Dorren

It is certified that error appears in the above-identified patent and that said Letters Patent are hereby corrected as shown below:

Please correct the Notice which appears between [73] and [21] on the front page of the Patent as follows:

The portion of the term of this patent subsequent to Jan. 2, 1990 has been disclaimed.

Signed and Sealed this

*Tenth* Day of *June 1980*

[SEAL]

*Attest:*

SIDNEY A. DIAMOND

*Attesting Officer*

*Commissioner of Patents and Trademark*